United States Patent [19]

Hague

[11] Patent Number: 4,467,582

[45] Date of Patent: Aug. 28, 1984

[54] JOINT RETENTION CLIP FOR RIB-LIKE PANEL JOINT

[75] Inventor: James G. Hague, Mars, Pa.

[73] Assignee: H. H. Robertson Company, Pittsburgh, Pa.

[21] Appl. No.: 426,703

[22] Filed: Sep. 29, 1982

[51] Int. Cl.[3] ..... E04D 3/362; E04D 3/38

[52] U.S. Cl. ..... 52/478; 52/419; 52/520; 52/546; 52/547; 52/714

[58] Field of Search ..... 52/478, 543, 544, 546, 52/520, 712, 713, 714, 547, 419

[56] References Cited

U.S. PATENT DOCUMENTS

| | | | |
|---|---|---|---|
| 3,302,357 | 2/1967 | Scott | 52/520 |
| 3,323,268 | 6/1967 | Johnson | 52/478 |
| 3,499,673 | 3/1970 | Soltysik et al. | 52/714 |
| 3,512,222 | 5/1970 | Tinnerman | 52/520 |
| 3,716,958 | 2/1973 | Scrivener | 52/520 |
| 3,775,922 | 12/1973 | Myers | 52/520 |
| 4,271,653 | 6/1981 | Buchhorn | 52/520 |
| 4,400,922 | 8/1983 | Boyer | 52/536 |

FOREIGN PATENT DOCUMENTS

| | | | |
|---|---|---|---|
| 255260 | 5/1963 | Australia | 52/520 |
| 42883 | 3/1970 | Australia | 52/520 |

*Primary Examiner*—Alfred C. Perham
*Attorney, Agent, or Firm*—G. E. Manias

[57] ABSTRACT

A joint retention clip for use in a rib-like joint formed by overlapping male and female partial ribs of adjacent panel members in a roof or wall structure. The joint retention clip maintains the partial ribs of the rib-like joint in assembled relation in the region between adjacent panel supports. The joint retention clip resides entirely on the protected side of a sealant bead and is thus not subject to corrosion; and exhibits improved resistance to applied vertical loads.

10 Claims, 9 Drawing Figures

JOINT RETENTION CLIP FOR RIB-LIKE PANEL JOINT

BACKGROUND OF THE INVENTION

1. Field of the Invention

This invention relates to roof or wall structures, and more particularly to improvements in joint retention clips for maintaining the elements of a rib-like joint in assembled relation in the region between adjacent panel support members.

2. Description of the Prior Art

Roof structures are known wherein profiled panel members are erected in side-by-side relation and secured to panel support members such as purlins or girts. Adjacent panel members are connected by interlocked marginal edges to form joints. Joint retention clips are installed in the joints between adjacent panel support members.

A profiled panel member and a joint retention clip are disclosed in application Ser. No. 249,062 (BOYER) filed Mar. 30, 1981 and assigned to the assignee of this invention and now U.S. Pat. No. 4,400,922. Each panel member presents spaced-apart longitudinal ribs, and male and female partial ribs along opposite longitudinal edges thereof. The partial ribs of adjacent panel members, when assembled in overlapped relation, form a rib-like joint which simulates one of the longitudinal ribs.

A number of problems arise in joints employing the BOYER joint retention clip. For example, the BOYER clip has a clip sidewall which is interposed between overlapped outer and inner sidewalls of the male and female partial ribs. For a short distance on either side of the clip sidewall, the inner and outer rib sidewalls are spaced-apart forming gaps on the weather side of the joint. During inclement weather, water may enter the gaps and eventually corrode the clip. Clip corrosion may result in long term structural deterioration of the joint and short term deterioration of the appearance of the roof due to rust streaking onto the panel face.

Two applications of sealant are required to fully encapsulate a top wall of the clip, that is, one beneath and another over the top wall of the clip. The possibility exists that moisture, introduced into the joint by capillary action, may find its way between one layer of the sealant and the clip—again resulting in corrosive deterioration of the clip.

As is known, the shape of a male partial rib may vary from the intended shape because of roll forming tolerances or because the male partial rib has been deformed during field-handling. As designed, the BOYER clip cannot accommodate shape variations of the male partial rib.

The BOYER clip presents a second clip leg engaged with the male partial rib, which resists vertical disengagement of the interlocked partial ribs. As designed, the second clip leg is inclined at an angle of about 40° relative to the vertical. Because of the large angle of inclination, the applied vertical load which can be resisted by the second clip leg—without collapse by bending—is limited and less than would be desired.

SUMMARY OF THE INVENTION

The present invention provides a joint retention clip which constitutes an improvement over the clip of copending application Ser. No. 249,062, now U.S. Pat. No. 4,400,922.

The principal object of this invention is to provide an improved joint retention clip which does not introduce the above-described problems into a rib-like joint.

Another object of this invention is to provide a joint retention clip which resides entirely on the protected side of the sealant bead and thus is protected from deterioration by corrosion.

Still another object of this invention is to provide a joint retention clip having improved resistance to applied vertical loads.

The present invention provides a joint retention clip comprising divergent wings members and clipping means for embracing an upper portion of a partial rib to retain the clip thereon. The wing members are disposed in side edge-to-side edge relation and diverge downwardly away from each other. The clipping means comprises an upper wall having a first side edge and a second side edge; a downturned flange depending from one side edge of the upper wall and preferably having a length which is less than the length of the upper sidewall; an arcuate side portion depending from the other side edge of the upper wall; and an upper segment of at least one of the wing members adjoined to the arcuate side portion. In the preferred arrangement, the wing members comprise three strips. That is, spaced-apart first and second strips each connected by one upper portion to and adjacent the opposite ends of the arcuate side portion and which depend therefrom laterally outwardly of the first side edge; and a third strip depending from and laterally outwardly of the arcuate side portion. The joint retention clip preferably is formed from spring steel such that the divergent wing members, when installed, will be elastically urged away from one another.

The present invention also provides a novel combination in a rib-like joint formed by a male partial rib and an overlapping female partial rib of adjacent panel members. The female partial rib comprises an outer crest; first and second sidewalls, one depending from each edge of the outer crest; an arcuate hug edge at the lower end of the second outer sidewall; and first inturned base portion connecting the first outer sidewall to a panel web of one panel member. The male partial rib comprises an upper portion adjacent to the outer crest; an inner sidewall depending from one edge of the upper portion adjacent to the second outer sidewall, and a second inturned base portion connecting the inner sidewall to a panel web of the other panel member.

In accordance with the present invention, the joint retention clip includes clipping means embracing the upper portion, and divergent wing members elastically urged away from one another and having lower edges engaged with interior surfaces of the inner sidewall and the first outer sidewall. A bead of sealant material, disposed along the entire length of the male partial rib is compressed between confronting interior surfaces of the female partial rib and the upper portion. The arrangement is such that the clip resides entirely on the protected side of the sealant bead and thus is not subject to corrosion. The clip does not affect the face-to-face contact between outer and inner legs of the interfitted ribs and thereby avoids the gaps formed by prior joint retention clips.

DESCRIPTION OF THE PREFERRED EMBODIMENT(S)

Figure 1:
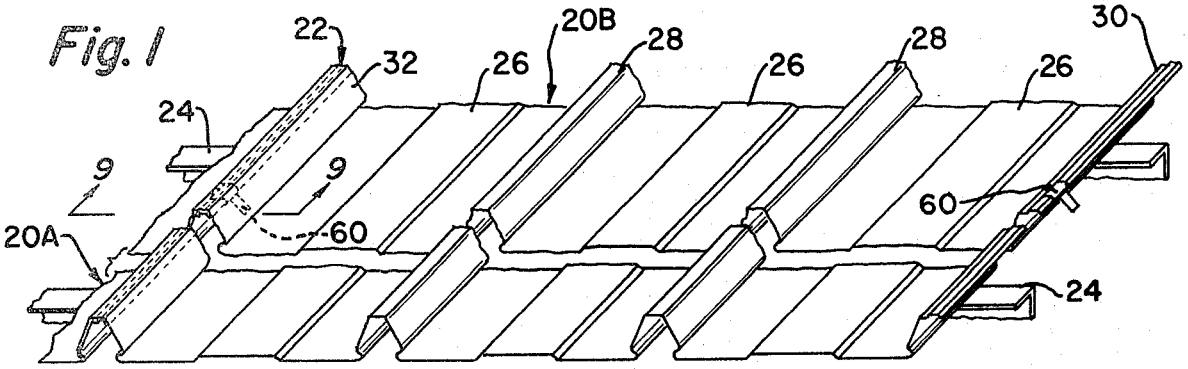
FIG. 1 is a fragmentary isometric view of panel members secured to spaced-apart panel supports.

FIG. 1 illustrates panel members 20A, 20B extending across adjacent panel supports 24. Each panel member 20 is profiled to present the plural panel webs 26, longitudinal ribs 28 each connecting adjacent ones of the panel webs 26, and male and female partial ribs 30, 32, respectively, along the opposite longitudinal edges of the panel 20. The panel members 20A, 20B are assembled in side-by-side overlapped relation wherein the partial ribs 30, 32 are interengaged to provide a rib-like joint 22 simulating one of the longitudinal ribs 28. A joint retention clip 60 is shown installed in the rib-like joint 22 and on the male partial rib 30.

Figure 2:
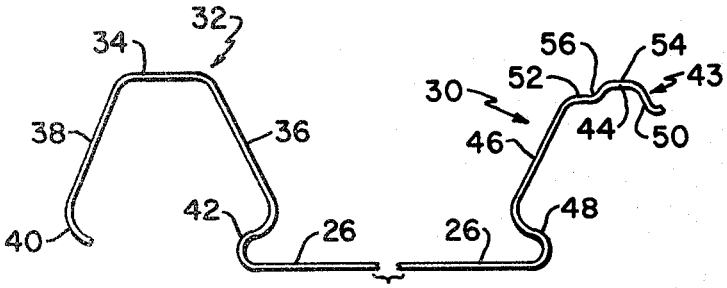
FIG. 2 is a fragmentary, broken end elevation of a panel member illustrating male and female partial ribs.

In the following description of the male and female partial ribs 30, 32, the terms "outer" and "inner" identify the relative position of the elements in the rib-like joint 22. Referring to FIG. 2, the female partial rib 32 comprises an outer crest 34, and first and second outer sidewalls 36, 38, one depending from each edge of the outer crest 34. The second outer sidewall terminates in an arcuate hug edge 40 adapted to engage a correspondingly curved outer surface of the male lip of an adjacent panel member. A first inturned base portion 42 connects the first sidewall 36 to the adjacent panel web 26.

Figure 8:
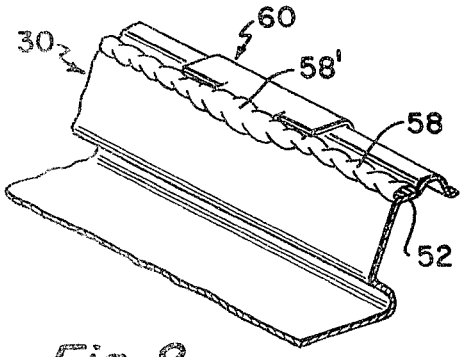
FIG. 8 is a fragmentary isometric view of a male partial rib provided with the joint retention clip and a bead of sealant material.

The male partial rib 30 includes an upper portion 43, an inner sidewall 46 depending from one edge of the inner crest 44, and a second inturned base portion 48 connecting the inner sidewall 46 to the adjacent panel web 26. The upper portion 43 comprises an inner crest 44 including a shoulder portion 52 connecting the inner crest 44 to the inner sidewall 46. The shoulder portion 52 is vertically offset, that is disposed below the level of an upper surface 54 of the inner crest 44. The shoulder portion 52 provides a recess 56 which receives a bead 58 of sealant material, as shown in FIG. 8.

Figure 3:
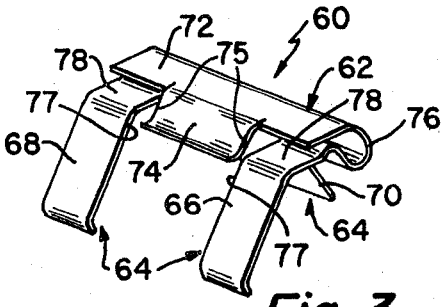
FIGS. 3 and 4 are a isometric views of the joint retention clip of this invention.
Figure 5:
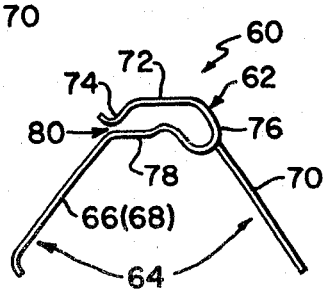
FIG. 5 is an end elevation view of the joint retention clip of FIGS. 3 and 4.

Referring to FIGS. 3 and 5, the joint retention clip 60 preferably is formed from a single piece of spring steel. In a commercial embodiment the joint retention clip 60 is formed from spring steel having a thickness of 0.022 inches (0.559 mm). The clip 60 includes a clipping means designated generally by the numeral 62, which is adapted to embrace the upper portion 43 (FIG. 2) of the male partial rib 30 as will be described; and wing members 64 disposed in side edge-to-side edge relation adjoin the clipping means 62 and which diverge downwardly away from each other.

Figure 4:
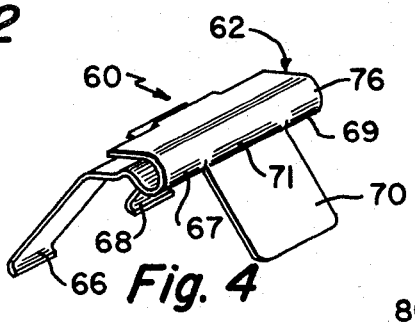

The wing members 64 include spaced-apart first and second strips 66, 68, one positioned at each end of the clipping means 62; and a third strip 70 adjoining the clipping means 62 at a central location thereon. The third strip 70 diverges away from the first and second strips 66, 68. As best seen in FIG. 4, the strips 66, 70, and 68 have aligned corresponding ends 67, 71, 69, respectively, adjoined to the arcuate side portion 76 of the clipping means 62.

Figure 6:
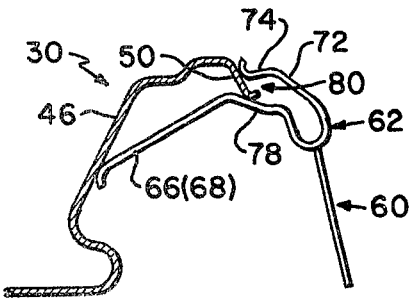
FIGS. 6 and 7 are end elevation views, illustrating the installation of the present joint retention clip on a male partial rib.
Figure 7:
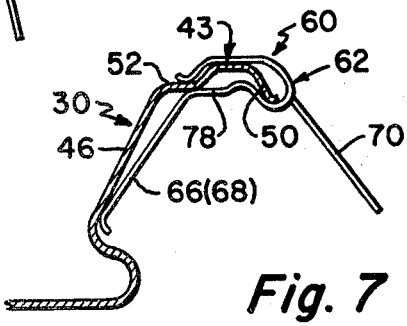

As best seen in FIGS. 3 and 5, the clipping means 62 comprises a generally rectangular upper wall 72, a downturned flange 74 depending from one side edge thereof, an arcuate side portion 76 depending from the other side edge thereof, and upper segments 78, one adjoining each of the first and second strip 66, 68 to the arcuate side portion 76. The downturned flange 74 presents opposite ends 75 adjacent to the confronting edges 77 of the first and second strips 66, 68. The upper segments 78 are proximate to the level of and cooperate with the flange 74 to define a restricted entranceway 80 (FIG. 5). When installing the clip 60 (FIG. 6), the inner partial sidewall 50 is introduced into the entranceway 80 and the clip 60 is rotated counterclockwise relative to the male partial rib 30. The flange 74 and the upper segments 78 are spread apart by the passage of the inner partial sidewall 50 while the strips 66(68) slide down the inner sidewall 46. When the clip 60 is installed, (FIG. 7), the clipping means 62 embraces the upper portion 43 thereby preventing lateral disengagement of the clip 60 from the rib 30.

It will be appreciated that the clip 60 engages the male partial rib 30 at three locations, that is at the inner partial sidewall 50, at the shoulder 52, and at the inner sidewall 46; and that the now-flexed strips 66 (68) urge the upper segments 78 laterally into hugging engagement with the inner partial sidewall 50. Hence variations in the configuration of the rib 30 caused by roll forming tolerances, or distortions of the rib 30 during field handling of the panel member will be accommodated by clipping means 62. That is, the clipping means 62 will automatically adjust its position to match that of the upper portion 43 of the male partial rib 30.

Figure 9:
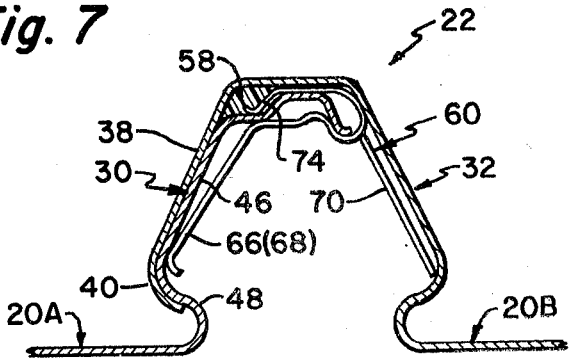
FIG. 9 is a cross-sectional view taken along the line 9—9 of FIG. 1, illustrating a rib-like joint incorporating the joint retention clip of this invention.

The sealant bead 58 (FIG. 8) is then applied along the entire length of the shoulder 52. It is preferred that the sealant bead 58 be allowed to build up slightly in the region of each of the clips 60, as shown at 58', to assure total encapsulation of the flange 74 (as shown in FIG. 9) and the subsequent formation of a weather-tight seal. The flange 74 preferably has a length which is less than the length of the upper wall 72 so that the volume of sealant required to encapsulate the flange 74 is minimized.

Thereafter, as shown in FIG. 9, the female rib 32 of the panel member 20B is snapped over the male partial rib 30 and the panel member 20A thus forming the rib-like joint 22. It will be observed that the arcuate edge 40 of the outer sidewall 38 is in full face-to-face contact with the inturned base portion 48 of the inner sidewall 46. Thus no water-admitting gaps are presented therebetween in the region of the clip 60. It will also be observed that the clip 60 is located entirely on the protected side of the sealant bead 58 and is protected from the corrossive action of water and other atmospheric contaminants.

The present arrangement is such that only a single application of sealant—the bead 58—is required. As shown in FIG. 9 the extreme end of the flange 74 is embedded in the sealant bead 58 whereby the passage of water between the clip 60 and the sealant bead 58 is prevented.

In the clip 60, the now-flexed strip 70 (FIG. 9) has a relatively steep inclination which improves the capacity of the clip to resist disengagement of the panels 20A, 20B. In particular, differential loading which results, for example, when live loads are applied only to the panel member 20A, is resisted to a greater degree than prior art arrangements.

In summary, the clip 60 overcomes disadvantages present in prior art joint retention clips. The present clip 60 is positioned entirely on the protected side of a sealant bead and is not subject to corrosion which would result in long term deterioration of the joint and short term deterioration in the appearance of the roof due to rust streaking onto the panel face. In addition, the present clip accommodates changes in the shape of the male partial rib and efficiently prevents a vertical disengagement of the interfitted ribs particularly during application of differential loadings.

I claim:

1. A joint retention clip comprising:

wing members disposed in side edge-to-side edge relation and diverging from aligned corresponding ends, downwardly away from each other; and clipping means for embracing an upper portion of a partial rib of a panel member to retain said clip thereon, said clipping means comprising:

an upper wall having a first side edge and a second side edge;

a downturned flange depending from one side edge of said upper wall and having a length which is less than the length of said upper wall;

an arcuate side portion depending from the other side edge; and an upper segment of at least one of said wing members adjoining said arcuate side portion.

2. The joint retention clip as defined in claim 1 wherein said wing members comprise:

spaced-apart first and second strips each connected by one said upper segment and depending therefrom laterally outwardly of the first side edge; and a third strip depending from and laterally outwardly of said arcuate side portion.

3. The joint retention clip as defined in claim 2 wherein said downturned flange has opposite ends adjacent to confronting edges of said first and second strips.

4. The joint retention clip as defined in claim 1 wherein said downturned flange is vertically offset from said upper segment to provide a restricted entranceway for receiving said upper portion.

5. In a rib-like joint formed by a male partial rib and a female partial rib of adjacent panel members and wherein said panel members extend transversely across spaced-apart panel supports, the combination comprising:

said female partial rib comprising an outer crest, first and second outer sidewalls, one depending from each edge of said outer crest, the second outer sidewall terminating in an arcuate hug edge, and a first inturned base portion connecting the first outer sidewall to a panel web of one of said panel members;

said male partial rib comprising an upper portion adjacent to said outer crest, an inner sidewall depending from one edge of said upper portion downwardly into engagement with the second outer sidewall, and a second inturned base portion connecting said inner sidewall to a panel web of the other of said panel members;

at least one joint retention clip provided in the region between adjacent ones of said panel supports, said clip including clipping means embracing said upper portion and retaining said clip thereon, and downwardly divergent wing members elastically urged away from one another into engagement with an interior surface of said inner sidewall of said male partial rib and an interior surface of the outer sidewall of said female partial rib; and a bead of sealant material compressed between confronting interior surfaces of said female partial rib and said upper portion;

said joint retention clip residing entirely on the protected side of said bead of sealant material.

6. The rib-like joint as defined in claim 5 wherein said upper portion includes:

an inner crest including a shoulder adjoined to said inner sidewall and offset downwardly below the level of said inner crest; and said clipping means includes a downturned flange overlying said shoulder, said flange having a length which is less than the length of said clipping means.

7. The rib-like joint as defined in claim 6 wherein said bead of sealant material encapsulates said downturned flange.

8. The rib-like joint as defined in claim 5 wherein said wing members include:

spaced-apart first and second strips, one adjacent each end of said clipping means and adjoined thereto; and a third strip adjoined to said clipping means at a central location thereon.

9. The rib-like joint as defined in claim 8 wherein said clipping means includes:

upper segments of said first and second strips which are generally parallel with but disposed below said upper portion.

10. The rib-like joint as defined in claim 1 or 5 wherein said joint retention clip is formed from spring steel.

* * * * *